US012196064B2

(12) United States Patent
Wroblicky et al.

(10) Patent No.: US 12,196,064 B2
(45) Date of Patent: Jan. 14, 2025

(54) REUSABLE SWITCH MODULE FOR GUN SYSTEM

(71) Applicant: GEODynamics, Inc., Millsap, TX (US)

(72) Inventors: Michael Wroblicky, Granbury, TX (US); Carson Brooks, Whitney, TX (US); Seth Powers, Weatherford, TX (US); Timothy Wayne Sampson, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 74 days.

(21) Appl. No.: 17/940,839

(22) Filed: Sep. 8, 2022

(65) Prior Publication Data

US 2024/0084678 A1 Mar. 14, 2024

(51) Int. Cl.
*E21B 43/1185* (2006.01)
*E21B 43/119* (2006.01)

(52) U.S. Cl.
CPC ..... *E21B 43/1185* (2013.01); *E21B 43/119* (2013.01)

(58) Field of Classification Search
CPC .. E21B 43/119; E21B 43/117; E21B 43/1185; E21B 43/116; E21B 43/11
See application file for complete search history.

(56) References Cited

U.S. PATENT DOCUMENTS

| | | | | |
|---|---|---|---|---|
| 11,402,190 | B2 * | 8/2022 | Sullivan | F42D 1/055 |
| 11,674,371 | B1 * | 6/2023 | Bradley | F42B 3/103 89/1.15 |
| 11,867,032 | B1 * | 1/2024 | Parks | E21B 43/1185 |
| 2020/0063536 | A1 * | 2/2020 | Walters | E21B 43/117 |
| 2020/0063537 | A1 * | 2/2020 | Langford | F42D 1/05 |
| 2021/0207934 | A1 * | 7/2021 | Sullivan | E21B 43/1185 |
| 2022/0120548 | A1 * | 4/2022 | Sullivan | E21B 43/1185 |
| 2023/0069950 | A1 * | 3/2023 | Badii | E21B 43/1185 |
| 2023/0287748 | A1 * | 9/2023 | Massey | E21B 17/06 |
| 2024/0084678 | A1 * | 3/2024 | Wroblicky | E21B 43/119 |

* cited by examiner

*Primary Examiner* — Daniel P Stephenson
(74) *Attorney, Agent, or Firm* — Morgan, Lewis & Bockius LLP

(57) ABSTRACT

A housing for an electrical component of a gun system is disclosed. The housing includes a housing body, an uphole bulkhead, and a downhole bulkhead. The housing body defines a cavity. The uphole bulkhead is disposed at least partially within the cavity. The downhole bulkhead is disposed at least partially within the cavity and opposite to the uphole bulkhead. The downhole bulkhead includes an electrical contact extending between a first end and a second end of the downhole bulkhead. The cavity, the uphole bulkhead, and the second end of the downhole bulkhead define a sealed volume configured to receive and isolate the electrical component. The electrical contact is configured to be electrically connected to the electrical component.

17 Claims, 3 Drawing Sheets

REUSABLE SWITCH MODULE FOR GUN SYSTEM

TECHNICAL FIELD

The present disclosure relates generally to perforating gun systems, and, more particularly, to switch modules for perforating gun systems.

BACKGROUND

Perforating gun systems can be used during the completion of oil and gas wells to create a flow path between the cased wellbore and formation. During completion operations, a perforating gun string is lowered into a well and fired to create holes in the casing and in the formation. Electronics, such as controllers or switches can be used to control the detonation of the charges in the perforating guns. In some applications, the electronics are exposed to wellbore conditions and/or the shock and pressure of perforating gun detonations, rendering the electronics non-functional. Therefore, in some applications, the electronics used with perforating gun systems are designed to be single-use devices.

However, one drawback of conventional single-use controllers or switches is that replacement electronics may be cost-prohibitive, unavailable, or may pose manufacturing or supply chain challenges. Further, certain conventional switch systems that were intended to withstand perforating gun detonations and the wellbore environment often included exposed wires and pins that were often damaged or destroyed during detonation events. Additionally, repairing and reusing conventional switch systems is labor intensive and costly. Therefore, what is needed is an apparatus, system or method that addresses one or more of the foregoing issues, among one or more other issues.

SUMMARY OF THE INVENTION

A housing for an electrical component of a gun system is disclosed. The housing includes a housing body, an uphole bulkhead, and a downhole bulkhead. The housing body defines a cavity. The uphole bulkhead is disposed at least partially within the cavity. The downhole bulkhead is disposed at least partially within the cavity and opposite to the uphole bulkhead. The downhole bulkhead includes an electrical contact extending between a first end and a second end of the downhole bulkhead. The cavity, the uphole bulkhead, and the second end of the downhole bulkhead define a sealed volume configured to receive and isolate the electrical component. The electrical contact is configured to be electrically connected to the electrical component.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

The present disclosure relates generally to perforating gun systems, and, more particularly, to switch modules for perforating gun systems. As described herein, embodiments of the switch module described herein address the issues described with respect to conventional switch modules and perforating gun systems.

In some applications, electronics used as a controller or switch for the detonation of charges in a perforating gun system can be sensitive to conditions experienced in a downhole environment and/or a detonation event. As described herein, replacing certain conventional switches after each use may be costly and resource-intensive. Further, repairing and reusing certain conventional switches may also be costly and time-consuming.

As described herein, embodiments of the switch module can include a sealed volume with an electrical contact that passes through the bulkhead allowing for reuse without time-consuming rewiring. Further, embodiments of the switch module can include a pass-through member to allow for additional protection of sensitive components.

Such arrangements can allow for reuse of components for multiple perforating gun detonations. Further the embodiments described herein can allow for the rotation of components without binding of wires or other connections. Advantageously, the components described herein can be utilized with various perforating gun modules or components and can also be utilized with certain conventional gun systems.

Figure 1:
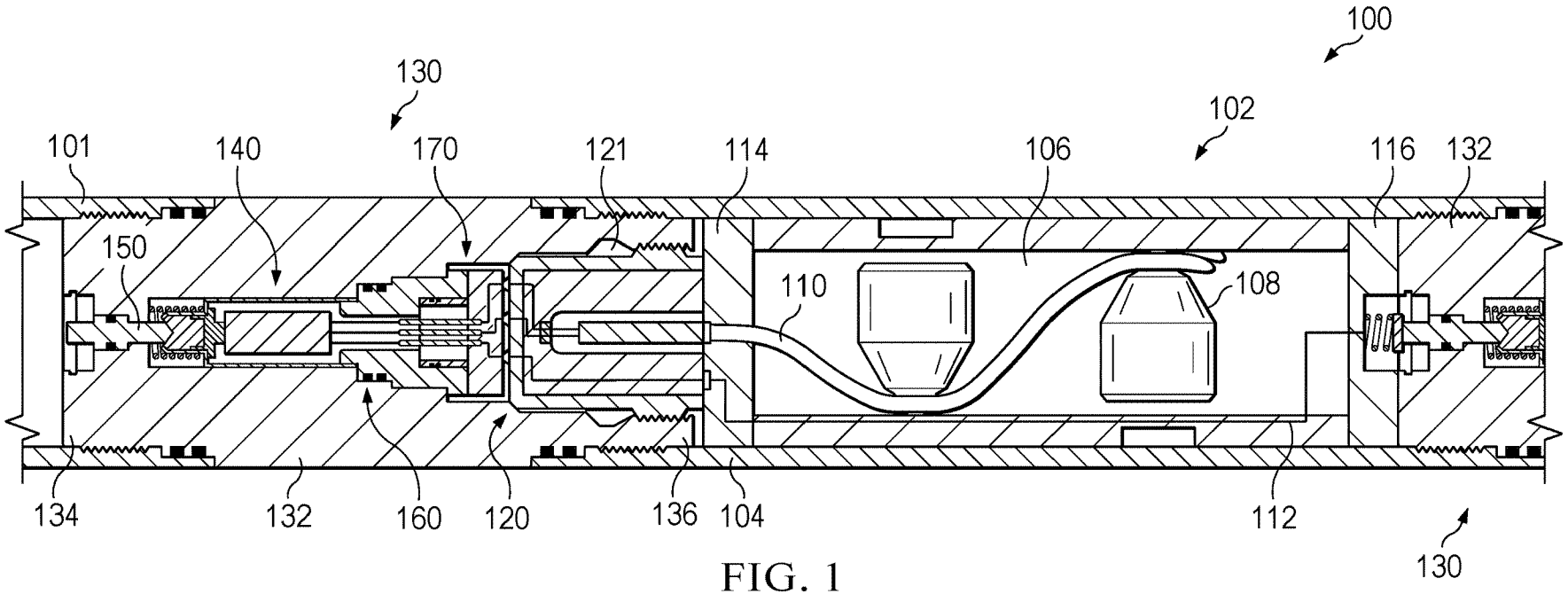
FIG. 1 is cross-sectional view of a perforating gun system.

FIG. 1 is cross-sectional view of a perforating gun system 100. With reference to FIG. 1, the perforating gun system 100 can be used during the completion of an oil and gas well to create a flow path between a cased wellbore and a formation. During a completion operation, the perforating gun system 100 can be lowered into a well and fired to create holes in the casing and in the formation to permit the flow of hydrocarbons.

In the depicted example, one or more perforating guns 102 of the perforating gun system 100 can detonate charges 108 to create holes in the casing and in the formation. In some embodiments, the charges 108 can be shaped charges, propellant, or any other suitable explosive. As illustrated, the charges 108 can be disposed within an outer carrier tube 104 of the perforating gun 102. The charges 108 can be interconnected by a detonating cord 110, allowing for the transfer of a detonation train. The charges 108 and the detonating cord 110 can be assembled together in an inner tube assembly 106. The inner tube assembly 106 can be inserted into the outer carrier tube 104.

Figure 2:
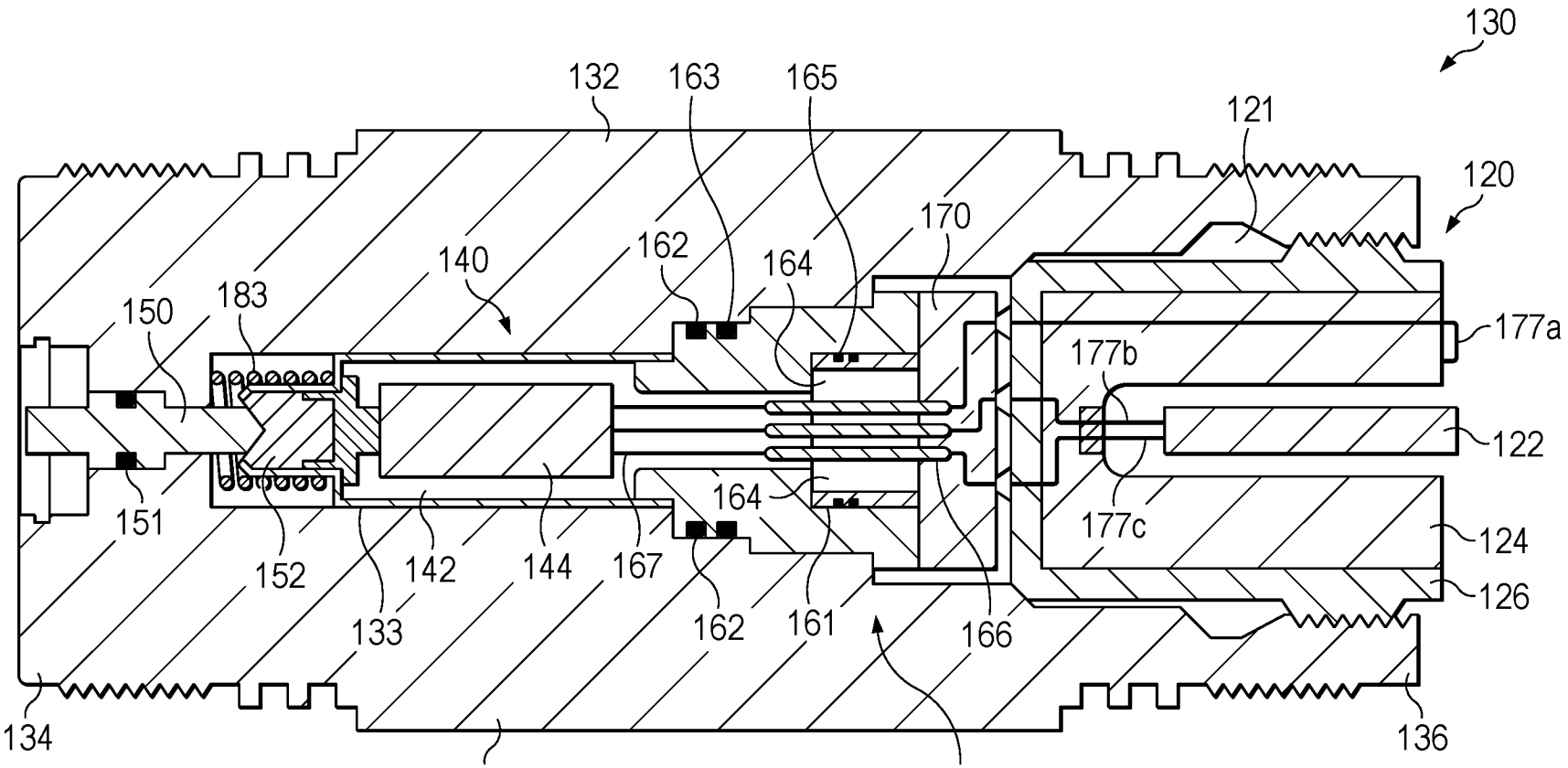
FIG. 2 is a cross-sectional view of a gun system connector for use with the perforating gun system of FIG. 1.

FIG. 2 is a cross-sectional view of a gun system connector 130 for use with the perforating gun system of FIG. 1. With reference to FIGS. 1 and 2, in some embodiments, the perforating gun system 100 can utilize and fire more than one perforating gun 102 to perforate multiple areas of a formation in a single operation. As illustrated, multiple perforating guns 102 can be connected together to form a gun string. Multiple perforating guns 102 can be connected together by a tandem sub 132 (generally referred to as a gun system connector 130). As illustrated, the outer carrier tube 104 of the perforating gun 102 can be coupled to a first end 134 and/or a second end 136 of the tandem sub 132. The outer carrier tube 104 can be threadedly coupled to the first end 134 and/or the second end 136 of the tandem sub 132.

In the depicted example, a detonation module 120 can initiate a detonation train along the detonating cord 110 to detonate the charges 108 in a respective perforating gun 102.

The charges 108 of each perforating gun 102 can be coupled to a wired detonator 122 in the respective detonation module 120. In some embodiments, the wired detonator 122 can be an ignitor or any suitable detonator. The operation of the wired detonator 122 can be controlled by a printed circuit board 124. The wired detonator 122 and the printed circuit board 124 of the detonation module 120 can be disposed in a housing 126.

As illustrated, the detonation module 120 associated with a corresponding perforating gun 102 (and coupled to the charges 108 therein) can be disposed in a cavity 121 formed in the tandem sub 132. In some embodiments, the detonation module 120 can be disposed at an uphole end of the perforating gun 102 and extend into the cavity 121 through the downhole end or second 136 of the tandem sub 132. In some embodiments, the housing 126 can be threadedly coupled in the cavity 121 of the tandem sub 132 to secure the detonation module 120 to the tandem sub 132.

During operation, a signal can initiate or trigger the detonation module 120 to control the detonation of the charges 108 in one or more desired perforating guns 102. In some embodiments, the signal to control the detonation module 120 can be provided from an uphole location, such as a perforating truck or other signal generator. In some embodiments, the signal to control the detonation module 120 can be transferred from uphole perforating guns 102 to downhole perforating guns 102 via system wiring 112 extending through perforating guns 102. Further, as described herein, signals can be passed through electrical connections in the gun system connector 130.

In the depicted example, a switch module 140 can activate or otherwise control the operation of the detonation module 120. In some embodiments, the switch module 140 can include an addressable controller or switch 144 to allow a user or system to select and activate a desired switch module 140 along the perforating gun system 100 string and detonate a corresponding desired perforating gun 102 via the respective detonation module 120. Advantageously, the use of an addressable controller or switch 144 allows for select fire operation of certain charges 108 and perforating guns 102 in the perforating gun system 100 allowing for enhanced control of completion operations within the wellbore.

As described herein, in some applications, certain electronics, such as the addressable switch 144 may be sensitive to the conditions of a downhole environment or pressure/shock generated during a detonation event. Therefore, electronics, such as the addressable switch 144 can be shielded, sealed, or isolated from the downhole environment and/or pressure/shock generated during a detonation event. As illustrated, the switch module 140 (including the addressable switch 144) can be housed within the tandem sub 132 to shield or isolate the addressable switch 144 from a hostile environment. Optionally, the addressable switch 144 can be disposed within a portion of the perforating gun 102, such as the outer carrier tube 104 or the inner tube assembly 106 to shield or isolate the addressable switch 144.

In the depicted example, addressable switch 144 is disposed and isolated in an envelope, chamber, or volume 142 at least partially defined by the tandem sub 132. As illustrated, the isolating volume 142 can be formed or defined by a cavity 133 defined by the body of the tandem sub 132, an uphole bulkhead 150, and a downhole bulkhead 160. In some embodiments, the uphole bulkhead 150 and the downhole bulkhead 160 can be disposed at least partially within the cavity 133 to define the volume 142.

In the depicted example, the uphole bulkhead 150 and the downhole bulkhead 160 can seal against uphole and downhole portions of the cavity 133 to seal and isolate the volume 142. Advantageously, the tandem sub 132 in conjunction with the sealing uphole bulkhead 150 and the downhole bulkhead 160 prevent the addressable switch 144 from being exposed to wellbore fluids, pressure, and shock.

For example, the uphole bulkhead 150 can be shaped to sealingly engage with the tandem sub 132 (or the walls of the cavity 133) to seal the volume 142. In some embodiments, the uphole bulkhead 150 includes resilient sealing elements 151 to sealingly engage between the uphole bulkhead 150 and the tandem sub 132. The sealing elements 151 may be elastomeric o-rings.

Similarly, the downhole bulkhead 160 can be shaped to sealingly engage with the tandem sub 132 (or the walls of the cavity 133) to seal the volume 142. In some embodiments, the downhole bulkhead 160 can have a multi-part configuration. For example, the downhole bulkhead 160 can include an outer bulkhead 162 and an inner bulkhead 164. As illustrated, the outer bulkhead 162 can be shaped to sealingly engage with the tandem sub 132 (or the walls of the cavity 133). The outer bulkhead 162 can include resilient sealing elements 163 to sealingly engage between the outer bulkhead 162 and the tandem sub 132. The sealing elements 163 may be elastomeric o-rings.

In some embodiments, an inner bulkhead 164 can be disposed within an opening, channel, or cavity 161 of the outer bulkhead 162. The inner bulkhead 164 can be shaped to sealingly engage with the outer bulkhead 162 to seal the volume 142. The inner bulkhead 164 can include resilient sealing elements 165 to sealingly engage between the inner bulkhead 164 and the outer bulkhead 162. The sealing elements 165 may be elastomeric o-rings.

In the depicted example, the uphole bulkhead 150 and the downhole bulkhead 160 can each allow for electrical signals to pass to and from the addressable switch 144 disposed and isolated within the volume 142. In some embodiments, the uphole bulkhead 150 allows for electrical signals from uphole components, such as a perforating truck or uphole perforating guns 102 to be transferred to the addressable switch 144. For example, the uphole bulkhead 150 can be formed from a conductive material or otherwise define a conductive pathway to allow an electrical signal to be transferred to the addressable switch 144. Optionally, electrical signals can be transferred from the uphole bulkhead 150 to the addressable switch 144 via an uphole contact 152 electrically coupled to the addressable switch 144. The uphole contact 152 can be a movable contact configured to move to maintain contact with the downhole end of the uphole bulkhead 150. As illustrated, the uphole contact 152 can include a biasing member 153 to direct or urge the uphole contact 152 toward the uphole bulkhead 150 to maintain electrical contact therebetween.

In the depicted example, the downhole bulkhead 160 allows for electrical signals from the addressable switch 144 to be transferred to downhole components, such as the detonation module 120 to allow for the activation of the wired detonator 122 and trigger the detonation of the charges 108 in the perforating gun 102. As illustrated, the inner bulkhead 164 can define one or more contacts, pins, or conductive pathways 166 through the inner bulkhead 164 to allow electrical signals to be transferred between the addressable switch 144 and the detonation module 120. In some embodiments, each of the conductive pathways 166 can extend between an uphole end and a downhole end of the inner bulkhead 164. As illustrated, the conductive pathways 166 can extend beyond the uphole and downhole ends of the inner bulkhead 164. Optionally, the uphole ends of the conductive pathways 166 can be directly electrically connected to the addressable switch 144 or connected to the addressable switch 144 via one or more wires 167. In the depicted example, the body of the inner bulkhead 164 can be formed around or otherwise sealingly engaged with the conductive pathways 166 to maintain a sealed or isolated volume 142. Advantageously, the use of contacts, pins, or conductive pathways 166 allows for the perforating gun system 100 to maintain an isolated volume 142 while allowing for the transfer of electrical signals between the isolated addressable switch 144 without requiring labor-intensive rewiring between uses.

Figure 3:
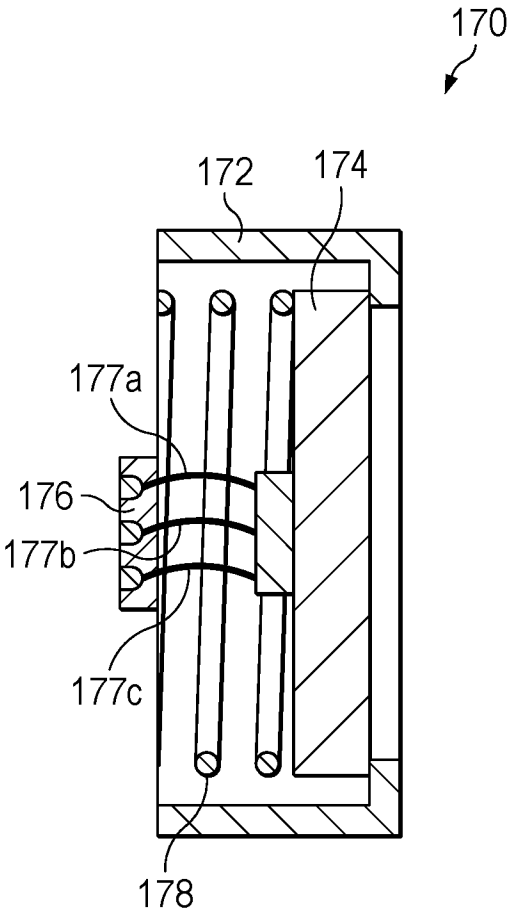
FIG. 3 is a cross-sectional view of a pass-through member for use with the gun system connector of FIG. 2.

With reference to FIGS. 2 and 3, optionally, the gun system connector 130 can include a pass-through member 170 to maintain electrical contact between the downhole bulkhead 160 and the detonation module 120. Further, the pass-through member 170 can be a disposable or sacrificial shield, or otherwise protect the downhole bulkhead 160 from damage from wellbore conditions and detonation events.

FIG. 3 is a cross-sectional view of an exemplary pass-through member 170 for use with the gun system connector 130 of FIG. 2. Pass-through member 170 may comprise a housing 172, within which may be disposed other elements, as discussed below in further detail.

As illustrated, a movable electrical contact or printed circuit board 174 may be electrically connected to the conductive pathways 166 of the downhole bulkhead 160. In some embodiments, the conductive pathways 166 can be directly or indirectly coupled to a pass-through electrical connection 176. The pass-through electrical connection 176 can be a terminal block or a printed circuit board with one or more electrical contacts. The pass-through electrical connection 176 can be electrically connected to the printed circuit board 174 by one or more wires 177. As shown in FIG. 2, two wires 177*b* and 177*c* may be connected to detonator 122, while another wire 177*a* may be used to communicate electrical signals to other components within perforating gun system 100 located downhole from gun system connector 130.

The printed circuit board 174 can include one or more electrical contacts to transfer electrical signals to the detonation module 120. In some embodiments, the printed circuit board 174 can be electrically connected to the detonation module 120 via one or more wires. During operation, the printed circuit board 174 can move to maintain electrical contact with the detonation module 120. As illustrated, the pass-through member 170 may include a deformable object or biasing member 178 to direct or urge the printed circuit board 174 toward the detonation module 120 to maintain positive contact force and electrical contact therebetween. In some embodiments, the range of motion of the printed circuit board 174 can be limited by features or protrusions of the housing 172.

Optionally, the pass-through member 170 can include a second printed circuit board that can move to maintain electrical contact with the conductive pathways 166 for the downhole bulkhead 160. Similarly, the second printed circuit board can include a deformable object or biasing member to direct or urge the second printed circuit board toward the downhole bulkhead 160 to maintain electrical contact therebetween. Advantageously, by utilizing multiple movable electrical contacts, the pass-through member 170 can maintain electrical contact with the downhole bulkhead 160 and the detonation module 120 in a variety of conditions and events.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A gun system housing comprising:

a housing body defining a cavity and comprising an uphole end and a downhole end;

an uphole bulkhead disposed proximate to the uphole end of the housing and configured to sealingly engage an inner surface of the housing;

a downhole bulkhead disposed proximate to the downhole end of the housing and configured to sealingly engage the inner surface of the housing;

an electrical contact disposed within the downhole bulkhead, comprising an uphole end and a downhole end, and extending between a first end and a second end of the downhole bulkhead;

a first electrical component disposed within the cavity between the uphole bulkhead and downhole bulkhead and configured to be electrically connected to the uphole end of the electrical contact; and a second electrical component disposed within the housing and configured to be electrically connected to the downhole end of the electrical contact.

2. The housing of claim 1, wherein the housing body comprises a tandem sub configured to attach to a gun carrier.

3. The housing of claim 1, wherein the housing body comprises a gun carrier.

4. The housing of claim 1, wherein the electrical contact comprises a conductive pin.

5. The housing of claim 4, wherein a first end of the conductive pin extends away from the first end of the downhole bulkhead and a second end of the conductive pin extends away from the second end of the downhole bulkhead and into the cavity.

6. The housing of claim 1, wherein the downhole bulkhead comprises an outer bulkhead that sealingly engages the inner surface of the housing and an inner bulkhead that sealingly engages an inner surface of the outer bulkhead, and the electrical contact extends through the inner bulkhead.

7. The housing of claim 1, wherein the uphole bulkhead comprises an uphole electrical contact configured to be electrically connected to the electrical component.

8. The housing of claim 1, wherein the electrical component comprises an addressable switch.

9. The housing of claim 1, wherein the second electrical component comprises a detonator or ignitor.

10. The housing of claim 1, further comprising a pass-through component comprising:

a pass-through electrical connection electrically connected to the downhole end of the electrical contact; and a movable electrical contact electrically connected to the pass-through electrical connection via a conductor, wherein the movable electrical contact is movable relative to the pass-through electrical connection.

11. The housing of claim 10, wherein the pass-through component further comprises a biasing member coupled to the movable electrical contact and configured to urge the movable electrical contact in a downhole direction.

12. A switch module for a gun system, the switch module comprising:

a tandem sub having a first end and a second end defining a cavity therebetween, wherein the first end and the second end are each configured to couple to components of the gun system;

an uphole bulkhead disposed at the first end of the tandem sub and at least partially within the cavity;

a downhole bulkhead disposed at least partially within the cavity, the downhole bulkhead comprising an electrical contact extending through the downhole bulkhead, wherein the cavity, the uphole bulkhead, and the downhole bulkhead define a sealed volume; and an addressable controller disposed within the sealed volume, electrically connected to the electrical contact, and configured to selectively send an electrical signal via the electrical contact; and a pass-through component comprising:

a pass-through electrical connection electrically connected to the electrical contact of the downhole bulkhead; and a movable electrical contact electrically connected to the pass-through electrical connection via a conductor, wherein the movable electrical contact is movable relative to the tandem sub.

13. The switch module of claim 12, wherein a first end of the electrical contact extends toward a first end of the tandem sub and into the sealed volume and a second end of the electrical contact extends toward the second end of the tandem sub.

14. The switch module of claim 12, wherein the downhole bulkhead comprises an outer bulkhead sealingly engaged with an inner surface of the tandem sub and an inner bulkhead sealingly engaged with an inner surface of the outer bulkhead, and the electrical contact extends through the inner bulkhead.

15. The switch module of claim 12, wherein the pass-through component further comprises a biasing member coupled to the movable electrical contact and configured to urge the movable electrical contact toward the second end of the tandem sub.

16. A gun system comprising:

a perforating gun comprising:

a gun carrier;

a charge disposed within the gun carrier; and a detonating cord coupled to the charge;

a tandem sub having a first end and a second end defining a cavity therebetween, wherein the second end of the tandem sub is coupled to the gun carrier;

an uphole bulkhead disposed at the first end of the tandem sub and at least partially within the cavity;

a downhole bulkhead disposed at least partially within the cavity, the downhole bulkhead comprising an electrical contact extending through the downhole bulkhead, wherein the cavity, the uphole bulkhead, and the downhole bulkhead define a sealed volume;

a pass-through component electrically connected to the electrical contact and disposed between the downhole bulkhead and the detonator, the pass-through component comprising:

a pass-through electrical connection electrically connected to the electrical contact of the downhole bulkhead; and a movable electrical contact electrically connected to the pass-through electrical connection via a conductor, wherein the movable electrical contact is movable relative to the downhole bulkhead;

an addressable switch electrically connected to a first end of the electrical contact and disposed within the sealed volume; and a detonator coupled to the detonating cord, electrically connected to a second end of the electrical contact, and disposed between the downhole bulkhead and the gun carrier, wherein the addressable switch is configured to selectively send an electrical signal to the detonator and detonate the charge.

17. The gun system of claim 16, wherein the pass-through component further comprises a biasing member coupled to the movable electrical contact and configured to urge the movable electrical contact in contact with the detonator.

* * * * *